US007575212B1

(12) United States Patent
Langelius

(10) Patent No.: US 7,575,212 B1
(45) Date of Patent: Aug. 18, 2009

(54) MOUNTING BRACKET

(75) Inventor: Robert Langelius, White Plains, NY (US)

(73) Assignee: Milton Merl & Associates, Inc., Long Island City, NY (US)

( * ) Notice: Subject to any disclaimer, the term of this patent is extended or adjusted under 35 U.S.C. 154(b) by 188 days.

(21) Appl. No.: 11/639,082

(22) Filed: Dec. 13, 2006

(51) Int. Cl.
*E06A 7/28* (2006.01)
*E04G 3/20* (2006.01)
*A47G 29/02* (2006.01)

(52) U.S. Cl. ..... 248/243; 248/225.21; 29/463; 29/469.5; 211/192; 211/94; 211/126

(58) Field of Classification Search ..... 248/221.11
See application file for complete search history.

(56) References Cited

U.S. PATENT DOCUMENTS

| | | | | |
|---|---|---|---|---|
| 844,367 | A | 2/1907 | Knape | |
| 1,974,050 | A | 9/1934 | Keil | |
| 3,250,584 | A | 5/1966 | Tassell | |
| 3,400,831 | A | 9/1968 | DeNiet | |
| 4,133,433 | A | 1/1979 | Wolf | |
| 4,387,872 | A * | 6/1983 | Hogue | 248/221.11 |
| 4,677,794 | A | 7/1987 | Parron et al. | |
| 4,700,916 | A * | 10/1987 | Bastian et al. | 248/224.8 |
| 4,712,286 | A * | 12/1987 | Wolf | 29/463 |
| 4,775,125 | A | 10/1988 | Pfeifer | |
| 4,852,839 | A | 8/1989 | Winter et al. | |
| 4,854,535 | A | 8/1989 | Winter et al. | |
| 4,895,331 | A | 1/1990 | Nehls | |
| 5,022,621 | A | 6/1991 | Quest | |
| 5,185,971 | A | 2/1993 | Johnson, Jr. | |
| 5,356,106 | A | 10/1994 | Trotta et al. | |
| 5,535,972 | A | 7/1996 | Fallago | |
| D416,471 | S * | 11/1999 | Wurdack | D8/363 |
| 6,422,523 | B1 * | 7/2002 | Weshler | 248/222.52 |

* cited by examiner

*Primary Examiner*—J. Allen Shriver, II
*Assistant Examiner*—Alaeddin Mohseni
(74) *Attorney, Agent, or Firm*—Ladas & Parry LLP

(57) ABSTRACT

A mounting bracket for a slotted upright featuring a channel member having a channel and a forwardly extending element. An insert is positioned within the channel member and has L-shaped fingers extending through the channel. The insert is secured within the channel member by fastening screws through the channel member and into the insert. When the bracket is placed on a slotted upright so that the L-shaped fingers of the insert are within the upright slots, tightening of the screws causes the fingers of the insert to engage the slots of the slotted upright and pushes the rear side of the channel member tightly against the slotted upright. This creates an overlying relationship where the L-shaped fingers and rear side of the channel member sandwich the slotted upright to provide an extremely secure connection. The mounting bracket is easily installed or removed by tightening or loosening the screws.

11 Claims, 5 Drawing Sheets

MOUNTING BRACKET

FIELD OF THE INVENTION

This invention relates generally to a mounting bracket assembly for slotted uprights which form an extremely secure connection and can be easily installed and removed.

BACKGROUND OF THE INVENTION

Various mounting brackets have been used to mount shelves or other forwardly extending elements on slotted uprights. However, many brackets provide securement that may be easily compromised by vertical or horizontal forces. For instance, U.S. Pat. No. 5,356,106 to Trotta is directed to a mounting bracket for a shelf where an L-shaped hook is placed within a slotted upright to attach the bracket with no other means to stabilize the connection. The Trotta device is easily displaced by vertical or horizontal forces.

Shelves resting on a mounting bracket installed on a slotted upright may not be level due to the slotted upright being uneven or misaligned with an adjacent slotted upright. Many mounting brackets do not provide means to level the shelving. For instance, U.S. Pat. No. 4,677,794 to Parron is directed to a support assembly for a shelf having a clamp assembly and support bar. The Parron device has no means to adjust the leveling of the shelving.

Furthermore, many mounting brackets that contain independent leveling means require complex adjustments or are difficult to install or remove. Additionally, they may be expensive to manufacture.

Accordingly, it is an object of the present invention to provide a mounting bracket that provides a connection with improved stability, when used either singly or in multiples.

Yet another object of the present invention is to provide a mounting bracket with an improved ability to provide a level outwardly extending element.

It is another object of the present invention to provide a mounting bracket that can be easily installed and removed.

A further object of the present invention is to provide a secure mounting bracket that is efficient and cost effective to manufacture.

SUMMARY OF THE INVENTION

The foregoing objects are met by the present invention directed to an improved mounting bracket assembly. The mounting bracket assembly features an insert having forwardly extending L-shaped fingers and a retaining surface oriented perpendicular to the L-shaped fingers. The insert is placed within a channel member with a vertical slot or channel in its wall and holes for securement means such as a screw on an opposite side. A shelf or other forwardly extending element is attached to the channel member.

The insert is positioned within the channel member so that the L-shaped fingers extend through the channel and the holes in the retaining surface of the insert are aligned with the holes in the channel member. The channel of the channel member may be smaller in width than the width of the retaining surface of the insert. The insert is secured within the channel member by inserting screws through the holes in the channel member and into threaded holes in the retaining surface of the insert.

The bracket is mounted on a slotted upright of conventional construction so that the outwardly extending portions of the L-shaped fingers of the insert are placed within upright slots. The screws are then tightened which causes the insert to be withdrawn into the channel member, the fingers of the insert engaging the slot webs of the slotted upright. Tightening of the screws also causes the rear side of the channel member to be pushed tightly against the slotted upright. The mounting bracket may have leveling means, such as a leveling screw inserted into an aperture on one end of the channel member and extending to contact the slotted upright. Tightening of the leveling screw causes displacement of an end of the mounting bracket with respect to the slotted upright thereby changing the angle of the forwardly extending bracket.

When fastened, the mounting bracket is positioned so that the slotted upright is sandwiched between the fingers of the insert and the rear side of the channel member. The overlying relationship of the fingers of the insert and the rear side of the channel member with the slotted upright creates an extremely secure connection and allows a level and stable connection in places where this may otherwise be exceedingly difficult. For instance, the overlying relationship can correct unevenness between posts with minor adjustments to one or both screws. The mounting bracket can be easily installed and removed from the upright by tightening or loosening the screws. A leveling screw, threadedly mounted to the channel member and projecting forward through the channel member slot, provides an auxiliary contact point with the slotted upright, allowing compensation for bracket sag and an additional support for the bracket, particularly when heavy loads are carried by the bracket.

DESCRIPTION OF THE DRAWINGS

The above and other objects, features and advantages of the present invention will become apparent from the following description of a preferred but, nonetheless, illustrative embodiment of the invention, taken in conjunction with the accompanying drawings, wherein FIG. 1 provides a side perspective view of two installed mounting brackets with a shelf placed on the forwardly extending element.

DETAILED DESCRIPTION OF THE PREFERRED EMBODIMENTS

Figure 1:
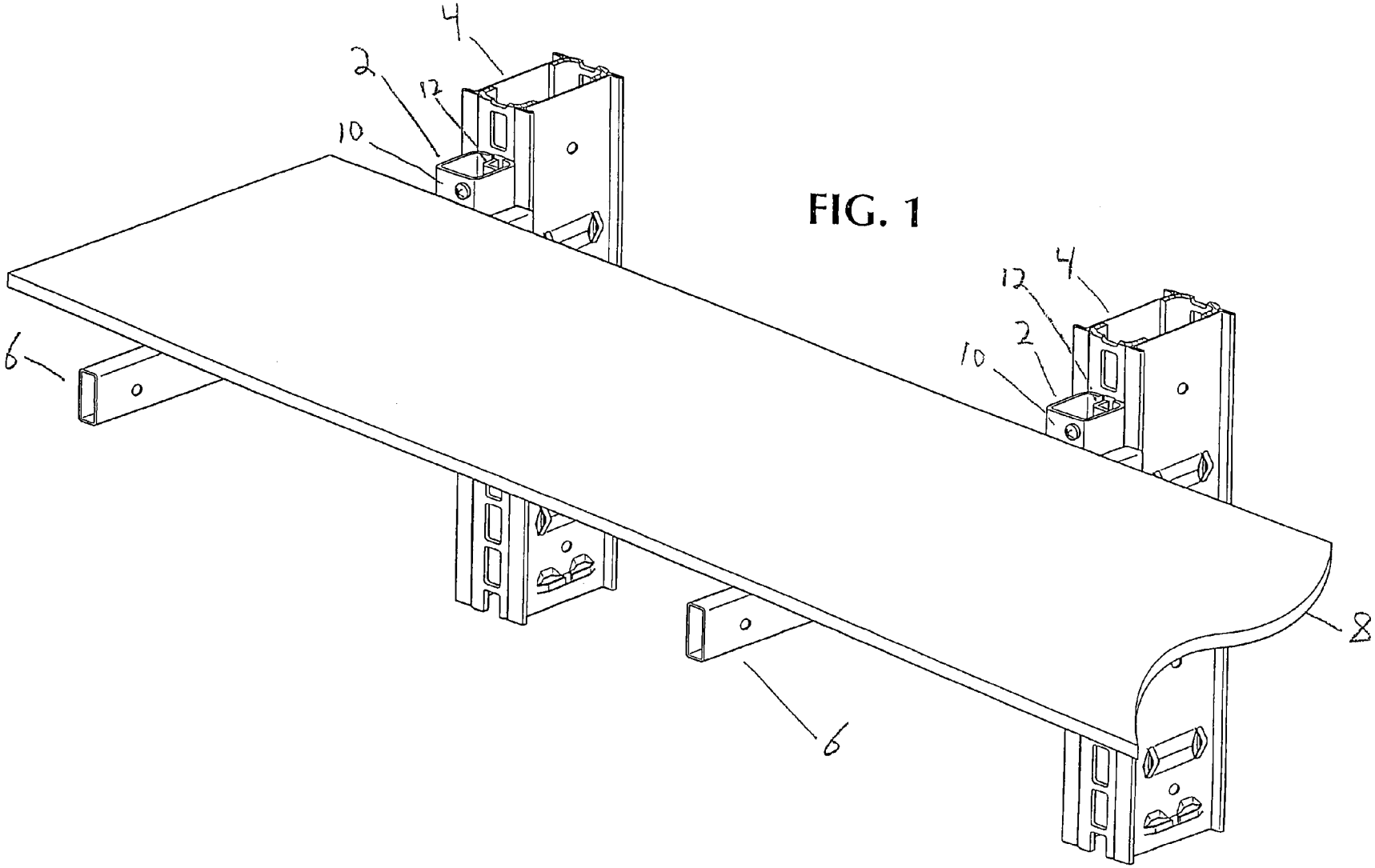

With particular reference to the drawings, the present invention is directed to an improved mounting bracket. FIG. 1 illustrates two mounting brackets 2 installed in adjacent slotted uprights 4. The forwardly extending elements 6 hold a shelf 8. Alternatively, a bin or other storage device can rest on the forwardly extending elements 6. Furthermore, while the drawings display a shelf supported on two adjacent mounting brackets 2, a single mounting bracket 2 may also be used to support a bin, shelf, or other device by fastening the device to the forwardly extending element 6 of the mounting bracket. Preferably, when a single mounting bracket 2 is used to support a shelf, the mounting bracket can include laterally extending members to provide additional support.

Figure 2:
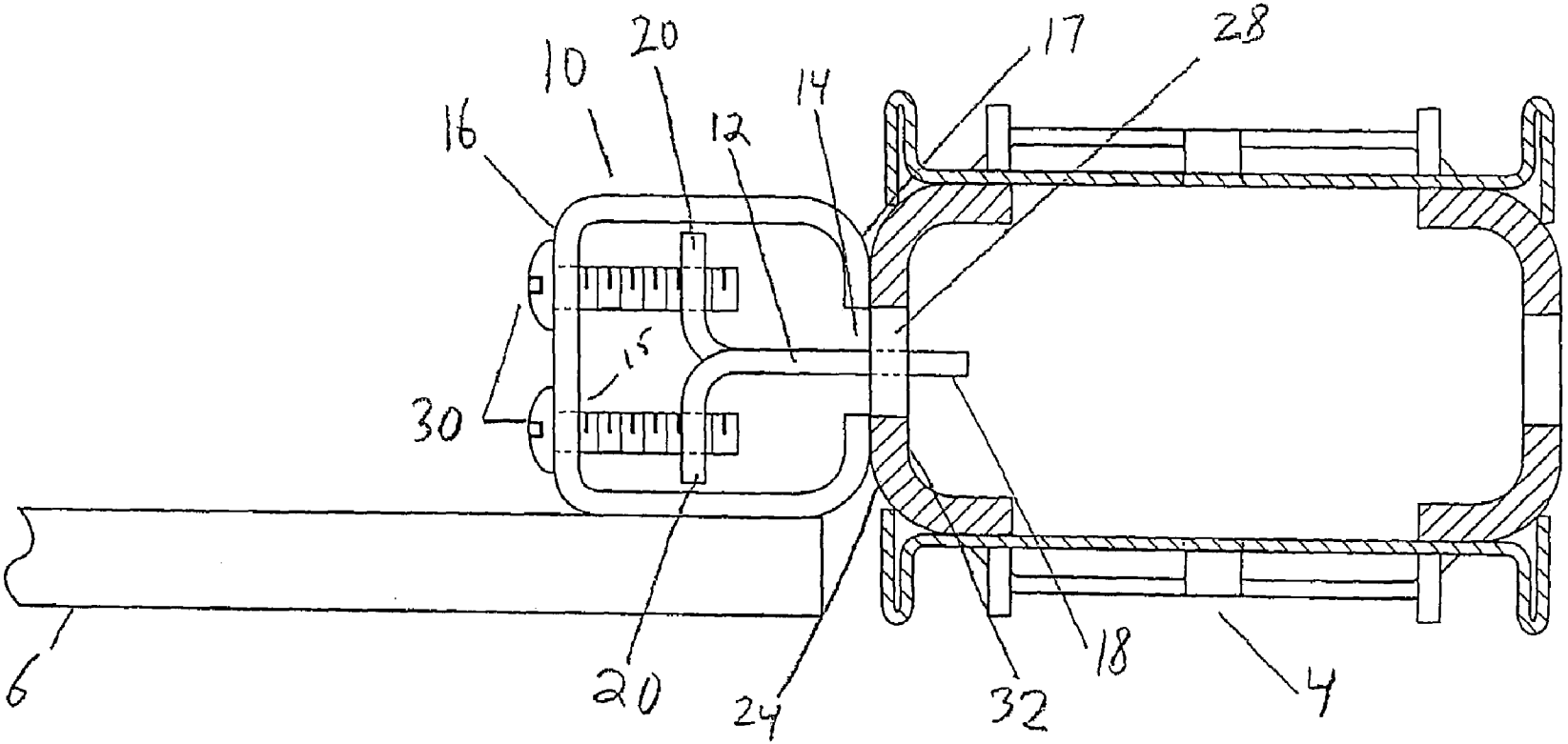
FIG. 2 provides a top plan view of the channel member and insert mounted in a slotted upright.
Figure 3:
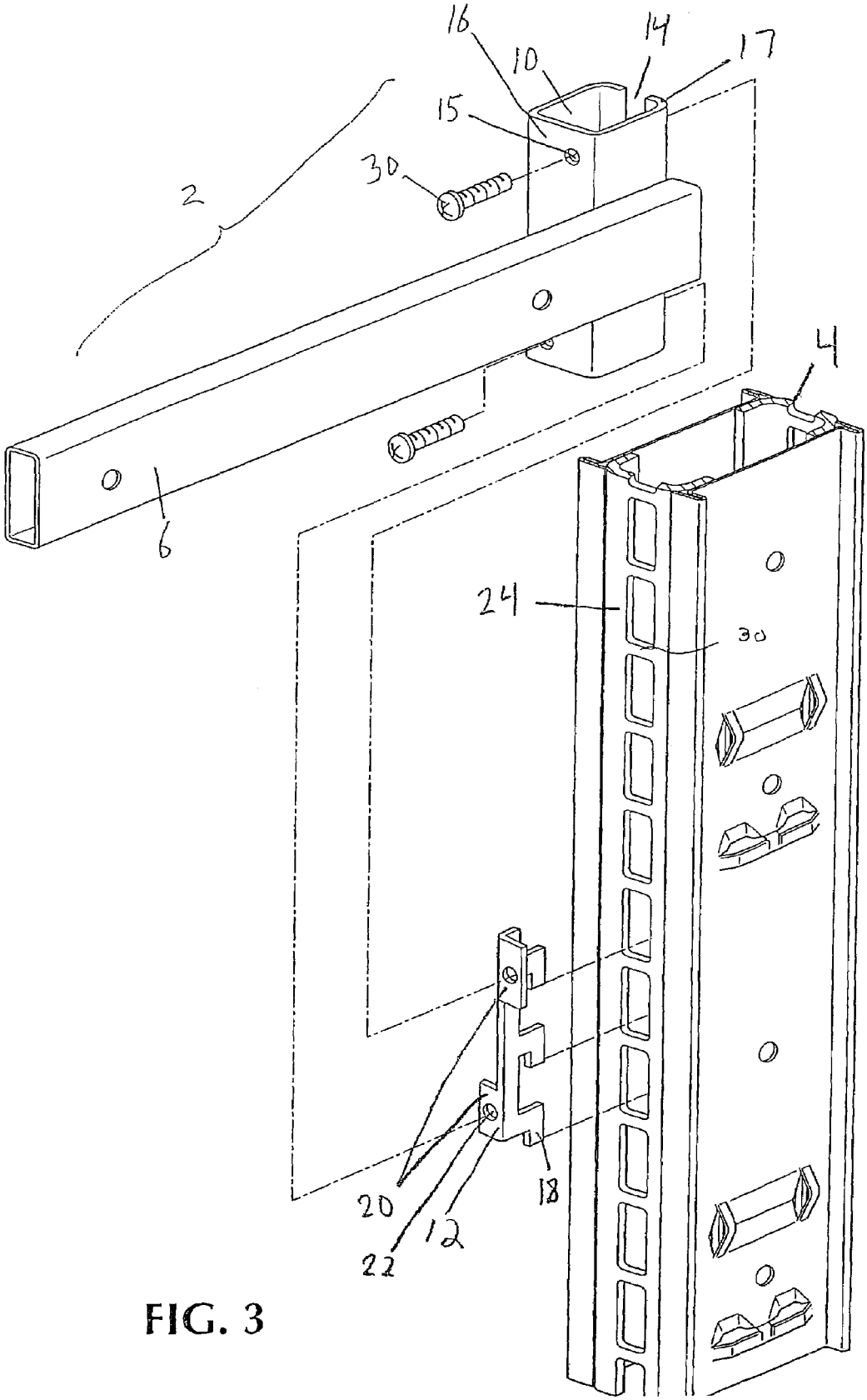
FIG. 3 provides a side exploded view of the channel member and insert installed in a slotted upright.
Figure 4:
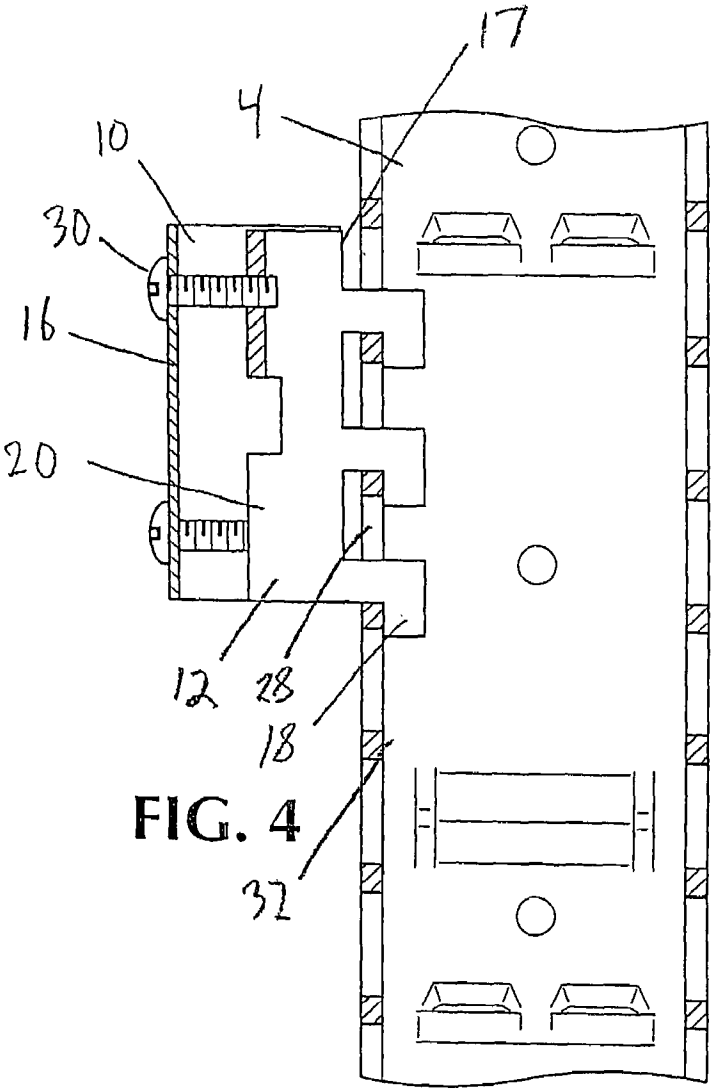
FIG. 4 provides a sectional view of the fingers of the channel member and insert mounted on a slotted upright.

FIGS. 2-4 illustrate the channel member 10 and insert 12 mounted on a slotted upright 4. The channel member 10 shown has a cylindrical shape with a front side 16 and 17 rear side. Alternatively, the channel member 10 can have a wide variety of different shapes. The channel member 10 has a channel 14 on the rear side and holes 15 for securement means. In the embodiment displayed, the channel 14 is directly in the middle of its rear side of the channel member. However, the channel 14 may be offset or positioned elsewhere on the rear side 17 of the channel member.

A forwardly extending element 6 is attached to the channel member 10. The forwardly extending element 6 may be welded so that it is integral with the channel member 10. Alternatively, the forward extending element 6 may be fastened on the channel member through various securement means well known in the art.

The mounting bracket 2 includes an insert 12 with outwardly extending L-shaped fingers 18 and a retaining surface 20 oriented perpendicular to the L-shaped fingers. The insert has holes 22 for securement means. In a preferred embodiment, the retaining surface 20 is bifurcated and configured with top and bottom portions extending in opposite directions in a common plane, as shown. In this embodiment, it is preferable that the holes 22 are on both the top portion and bottom portion of the retaining surface 20 so that the holes are oriented towards opposite sides of the channel, with the holes 15 in the channel member being similarly disposed.

The insert 12 is positioned within the channel member 10 so that the L-shaped fingers 18 extend through the channel 14 and the holes 20 in the retaining surface of the insert are aligned with the holes 15 in the channel member. The channel 14 of the channel member may be smaller in width than the width of the retaining surface 20 of the insert. Securement means 26 extend through the holes 15 in the channel member and into threaded holes 22 of the retaining surface of the insert. The securement means 26 may be screws 30 as displayed in the drawings or other fastening elements known in the art.

The mounting bracket 2 is positioned on the slotted upright 4 so that the L-shaped fingers 18 of the insert are placed within the apertures 28 of the slotted uprights. The screws 30 are then tightened which causes the fingers 18 of the insert to engage the interior surface 32 of the slotted upright and pushes the rear side 17 of the channel member tightly against the front side 24 of the slotted upright. In a preferred embodiment, the rear side 17 of the channel member is shaped to match the contours of the front side of the slotted upright 24 providing a flush relationship between the two when the mounting bracket is tightened.

Figure 5:
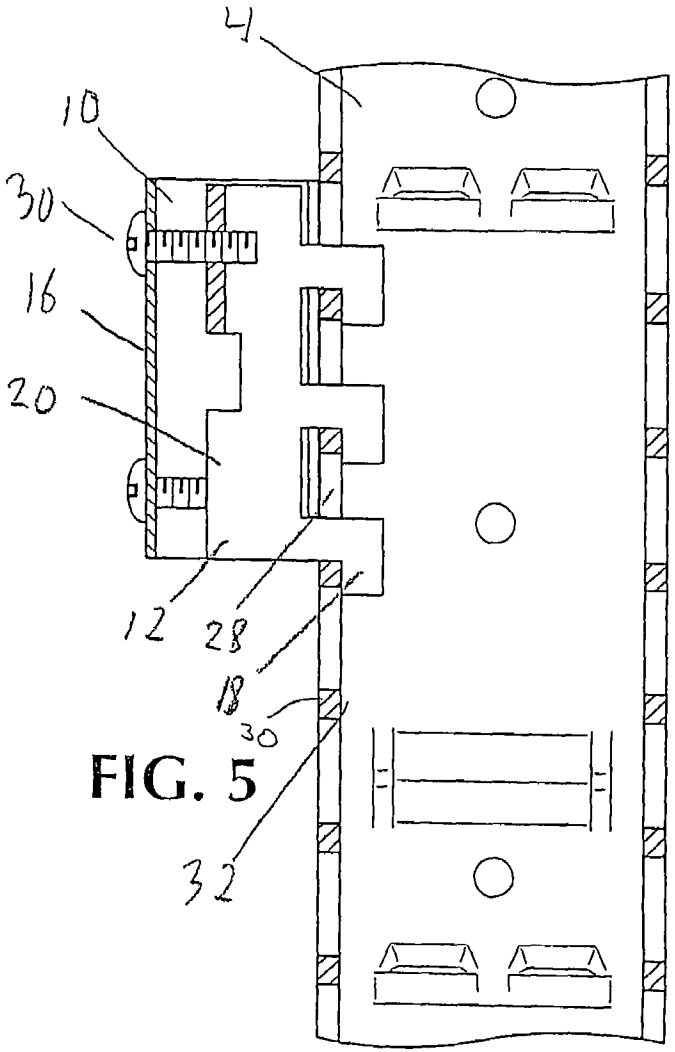
FIG. 5 provides a sectional view of the fingers of the channel member and insert mounted on a slotted upright with the screws fastened.

As displayed in FIG. 5, when fully fastened, the mounting bracket 2 is positioned so that the slotted upright 4 is sandwiched between the fingers of the insert 18 and the rear side 17 of the channel member creating an extremely secure, stable, and level connection. Furthermore, the opposed orientation of the holes 22 in the retaining surface 20 and complementary holes 15 in the channel member which the screws 30 extend through creates two separate points of contact through the channel member 10 and causes the securement force provided by the screws 30 to be balanced on both sides of the fingers of the insert 18. This provides an extremely rigid connection that prevents lateral and rotational movement to maintain the mounting bracket 2 in a perpendicular orientation with the upright 4. The mounting bracket 2 can be easily installed and removed from the upright 4 by tightening or loosening the screws 30.

Figure 6:
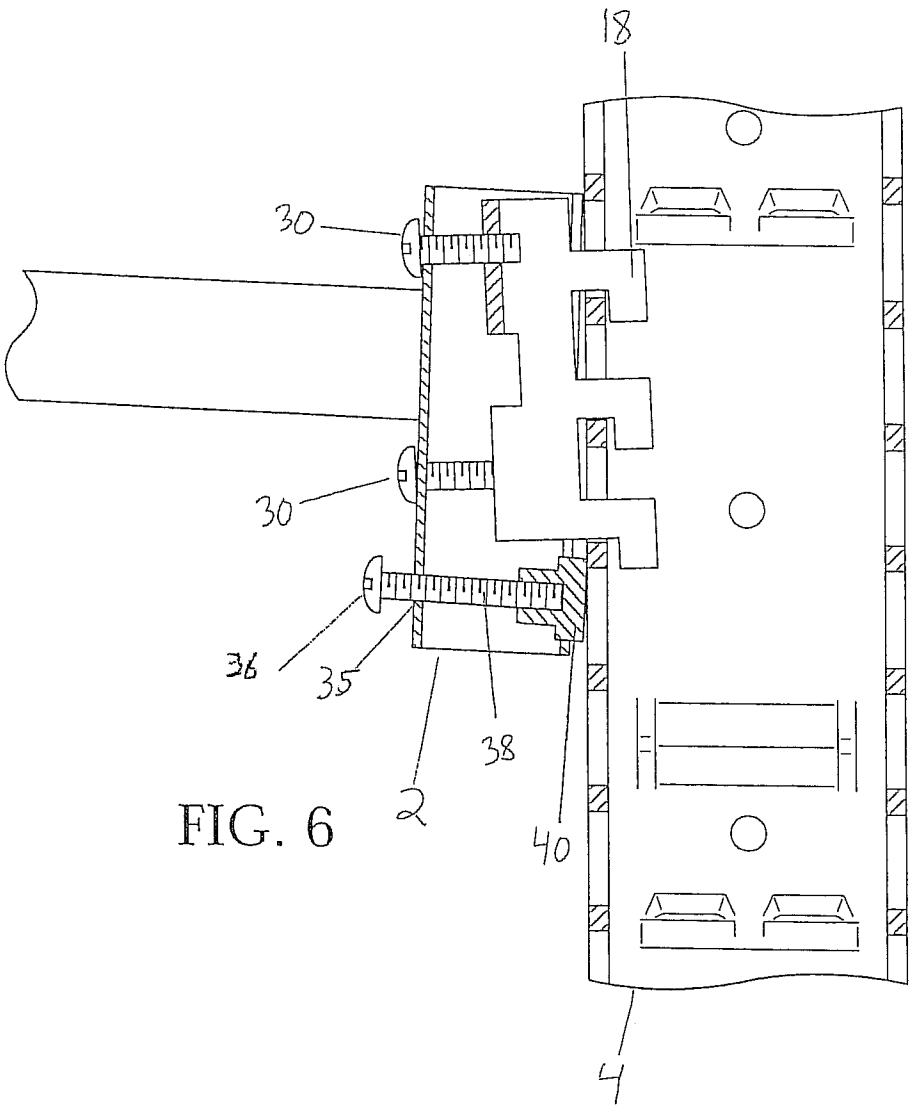
FIG. 6 provides a sectional view of the fingers of the channel member and insert mounted on a slotted upright with the leveling screws fastened.

With reference to FIG. 6, the mounting bracket 2 may have leveling means which allows the user to adjust the angle that the forwardly extending element 6 extends before tightening the screws 30 which secure the L-shaped fingers 18 of the insert to the slotted upright 4. The leveling means may comprise a leveling screw 36 which is inserted into a threaded aperture 35 on one end of the channel member 10 as shown in FIG. 6. Alternatively, a leveling member (not shown) may be secured to an end of the mounting bracket 2 and the leveling member has an aperture adapted to receive the leveling screw 36.

The head of the leveling screw may have a hexagonal opening for engagement by an alien wrench or may have a horizontal opening or a Phillips head shaped opening for engagement by a screwdriver. The body 38 of the leveling screw has a flat contacting insert 40 attached to its distal end. The flat contacting insert 40 projects forward past the channel member 10 and contacts the front side 24 of the slotted upright. The contacting insert 40 may be constructed of a flexible material such as rubber so that when the angle that the leveling screw 36 contacts the slotted upright changes as the leveling screw is fastened, the end of the contacting insert 40 remains flush with the surface of the slotted upright. In the embodiment where one end of the channel member 10 is extended to accommodate the leveling screw 36, the channel 14 does not continue to the extended portion of the channel member 10 thereby allowing the body 38 of the leveling screw to extend unencumbered beyond the front side of the channel member 10. Alternatively, the channel 14 could extend to the area around the leveling screw 36 and the leveling screw has a width that is narrower than the channel 14 to allow the leveling screw to extend unencumbered through the channel.

The leveling screw 36 provides an auxiliary contact point with the slotted upright 4 allowing compensation for bracket sag and an additional support for the bracket 2, particularly when heavy loads are carried by the bracket. Tightening and loosening of the leveling screw 36 causes displacement of the end of the mounting bracket 2 with respect to the slotted upright 4 and changes the angle of the forwardly extending element 6 for a more secure attachment of the mounting bracket 2 and an improved leveling of shelves or other storage articles on the forward extending elements. Additionally, the overlying relationship of the channel member 14 and fingers 18 of the insert when mounted allows for micro adjustments of the forward extending elements 6 by tightening or loosening one or screws 30 which allows for further leveling of the shelves.

What is claimed is:

1. A mounting bracket for a slotted upright comprising:

a channel member having a front wall, two side walls, and a rear wall, said front, side, and rear walls being integral with each other and all extending vertically an entire height of the channel member, said front, side, and rear walls forming a substantially surrounded compartment for receiving an insert, said rear wall comprising first and second portions extending mutually inwardly towards each other from a rear of said side walls and defining a narrow vertically-extending channel therebetween, said channel member also having a forwardly-extended element attached to an exterior face of a side wall of said channel member;

said insert positioned inside said compartment of said channel member, said insert having a retaining surface within the compartment, a plurality of L-shaped projections extending outwardly through said channel; and means for securing said insert within said channel member, wherein tightening of said securing means causes said L-shaped projections to move in a frontward direction thereby engaging an interior surface of the slotted upright when positioned therein and urging exteriors of the first and second portions of the rear wall of the channel member tightly against a front side of said slotted upright to create a stable connection.

2. The mounting bracket as set forth in claim 1 wherein said securing means comprises a screw mounted through said front wall of the channel member and threadably engaging said retaining surface of the insert.

3. The mounting bracket as set forth in claim 1 wherein the exterior of said rear wall of said channel member is shaped to match the contours of the exterior of said slotted upright to provide further stability.

4. The mounting bracket as set forth in claim 1 wherein said retaining surface includes a first portion and a second portion, said first and second portions are positioned perpendicular to the L-shaped projections and comprise a pair of spaced bracket elements each joined to a forward edge of the L-shaped projections and extending in opposite directions from each other in a common plane.

5. The mounting bracket as set forth in claim 4, wherein the securement means comprise first and second screws mounted in said front wall of the channel member and each separately engaging a different one of the first and second retaining surface portions to provide two separate points of securement of the channel member said points of securement being balanced on both sides of the L-shaped projections.

6. The mounting bracket as set forth in claim 4, wherein the first and second retaining surface portions are formed from a unitary piece of material.

7. The mounting bracket as set forth in claim 1, wherein said mounting bracket further comprises leveling means for adjusting the angle of said forwardly-extended element.

8. The mounting bracket as set forth in claim 7, wherein said leveling means comprises:

a leveling screw inserted into an aperture on an end of said mounting bracket, the distal end of said leveling screw contacting said slotted upright; and said leveling screw when fastened through said aperture causes the distance between said end of said mounting bracket and said slotted upright to increase thereby allowing adjustment of the angle of said forwardly extended element by loosening or tightening said leveling screw.

9. The mounting bracket as set forth in claim 8, wherein a contacting insert is secured to said distal end of said leveling screw.

10. The mounting bracket as set forth in claim 9, wherein said contacting insert is constructed of a flexible material.

11. The mounting bracket as set forth in claim 1, wherein said channel member has a vertical height that is greater than a vertical height of said forwardly-extending element.

* * * * *